US005186475A

United States Patent [19]

Kawai et al.

[11] Patent Number: 5,186,475

[45] Date of Patent: Feb. 16, 1993

[54] GASKET HAVING RETAINER ELEMENT FOR REED VALVE INTEGRALLY FORMED THEREWITH

[75] Inventors: Katsunori Kawai; Atsushi Fukaya; Toshiyuki Nakajima, all of Kariya, Japan

[73] Assignee: Kabushiki Kaisha Toyoda Jidoshokki Seisakusho, Kariya, Japan

[21] Appl. No.: 879,620

[22] Filed: May 7, 1992

[30] Foreign Application Priority Data

May 9, 1991 [JP] Japan ..... 3-32022[U]

[51] Int. Cl.[5] ..... F16J 15/00; F04B 25/04

[52] U.S. Cl. ..... 277/181; 277/235 R; 277/235 A; 137/856

[58] Field of Search ..... 277/181, 227, 235 R, 277/235 A; 137/856

[56] References Cited

U.S. PATENT DOCUMENTS

| | | | |
|---|---|---|---|
| 4,168,722 | 9/1979 | Mayer et al. | 137/856 |
| 4,257,457 | 3/1981 | Namura et al. | 137/856 |
| 4,886,424 | 12/1989 | Ikeda et al. | 137/856 |
| 4,911,614 | 3/1990 | Kawai et al. | 137/856 |

*Primary Examiner*—William A. Cuchlinski, Jr.
*Assistant Examiner*—Daniel G. DePumpo
*Attorney, Agent, or Firm*—Brooks Haidt Haffner & Delahunty

[57] ABSTRACT

A gasket has a retainer element integrally formed therewith for a reed valve. The retainer element is defined by one or two pairs of contour lines or by a pair of geometrically combined contour lines, and these contour lines are arranged such that no contour line will act as if it were a hinge when the retainer element is subjected to a deformation force thereof, and thus the retainer element is able to sufficiently withstand a deformation force exerted thereon.

11 Claims, 7 Drawing Sheets

GASKET HAVING RETAINER ELEMENT FOR REED VALVE INTEGRALLY FORMED THEREWITH

BACKGROUND OF THE INVENTION (1) Field of the invention

The present invention relates to a gasket having a retainer element for a reed valve integrally formed therewith, which gasket may be incorporated in a compressor for an air-conditioning system used in a vehicle such as an automobile.

(2) Description of the Related Art

For example, a well-known swash plate type compressor comprises: front and rear cylinder blocks axially combined to form a swash plate chamber therebetween, the combined cylinder blocks having a same number of cylinder bores radially formed therein and arranged with respect to the central axis thereof, the cylinder bores of the front cylinder block being aligned and registered with the cylinder bores of the rear cylinder block, respectively, with the swash plate chamber intervening therebetween; double-headed pistons slidably received in the pairs of aligned cylinder bores, respectively; front and rear housings fixed to front and rear end faces of the combined cylinder blocks through the intermediary of front and rear valve plate assemblies, respectively, the front and rear housings each forming a suction chamber and a discharge chamber together with the corresponding one of the front and rear valve plate assemblies; a rotatable drive shaft arranged so as to be axially extended through the front housing and the combined cylinder blocks: and a swash plate securely mounted on the drive shaft within the swash plate chamber and engaging with the double-headed pistons to cause these pistons to be reciprocated in the pairs of aligned cylinder bores, respectively, by the rotation of the swash plate. The front and rear cylinder blocks, the front and rear valve plates and the front and rear housings are axially and tightly assembled as an integrated unit by a plurality of long screw bolts extended therethrough.

The front and rear valve plate assemblies in particular have substantially the same construction, in that each comprises: a disc-like member having sets of a suction port and a discharge port each set of which is able to communicate with the corresponding one of the cylinder bores of the front or rear cylinder block; an inner valve sheet attached to the inner side surface of the disc-like member and having suction reed valve elements formed integrally therein, each of which is arranged so as to open and close the corresponding suction port of the disc-like member; an outer valve sheet attached to the outer side surface of the disc-like member and having discharge reed valve elements formed integrally therein, each of which is arranged so as to open and close the corresponding discharge port of the disc-like member; and a gasket attached to the outer valve sheet and hermetically engaged with an end face of a partition wall of the front or rear housing defining the suction and discharge chambers. Each of the front and rear valve plate assemblies is also provided with suction openings aligned with passages formed in the front or rear cylinder block, respectively, whereby the suction chambers formed by the front and rear housings are in communication with the swash plate chamber into which a refrigerant is introduced from an evaporator of an air-conditioning system, through a suitable inlet port formed in the combined cylinder blocks.

In the swash plate type compressor as mentioned above, the drive shaft is driven by the engine of a vehicle, such as an automobile, so that the swash plate is rotated within the swash plate chamber, and the rotational movement of the swash plate causes the double-headed pistons to be reciprocated in the pairs of aligned cylinder bores. When each piston is reciprocated in the aligned cylinder bores, a suction stroke is executed in one of the aligned cylinder bores and an compression stroke is executed in the other cylinder bore. During the suction stroke, the suction reed valve element is opened and the discharge reed valve element is closed, whereby the refrigerant is delivered from the suction chamber to the cylinder bore through the suction port. During the compression stroke, the suction reed valve element concerned is closed and the discharge reed valve element concerned is opened, whereby the delivered refrigerant is compressed and discharged from the cylinder bore into the discharge chamber, through the discharge reed valve element.

When the refrigerant is discharged through the discharge reed valve, the discharge reed valve element must be held at a given angle, to thereby prevent an excessive bending of the discharge reed valve element. Accordingly, it has been proposed that a retainer element be integrally formed in the gasket of the front or rear valve plate assembly, to provide a sloped surface on which the discharge reed valve can bear. The integral formation of the retainer elements in the gasket is carried out by a press. In this case, conventionally, the retainer element is defined by a pair of outer straight contour lines substantially included in a plane of the gasket and by a pair of inner straight contour lines disposed between the outer straight contour lines and above the plane of the gasket. In particular, the sloped bearing surface of the retainer element is extended between the inner contour lines, and each of the side walls of the retainer element is extended downward from one of the inner contour lines to the corresponding one of the outer contour lines.

During the discharge of the refrigerant, the discharge reed valve element is pressed against the sloped bearing surface of the retainer element, and thus a pressure produced by the discharged refrigerant is directly exerted upon the retainer element, as a deformation force thereof, and when the retainer element is subjected to such a deformation force, each straight contour line acts as if it were a hinge, and as a result, the conventional retainer element may be prematurely broken along the straight contour lines. Although it is possible to thicken the gasket to prevent a breakage of the retainer element, this increases the weight of the compressor and increases the production cost thereof.

SUMMARY OF THE INVENTION

Therefore, an object of the present invention is to provide a gasket having a retainer element for a reed valve integrally formed therewith for a reed valve, wherein the retainer element is arranged such that it can sufficiently withstand a deformation force exerted thereupon.

In accordance with the present invention, there is provided a gasket for a reed valve comprising a plate-like gasket body having at least one retainer element integrally formed therewith, the retainer element providing a sloped bearing surface for holding the reed valve at a given angle, the retainer element being defined by a pair of curved outer contour lines substantially included in a plane of the gasket body and by a pair of curved inner contour lines disposed between the curved outer contour lines and above the plane of the gasket body, the sloped bearing surface of the retainer element being extended between the curved outer contour lines, and each of side walls of the retainer element being extended from one of the curved outer contour lines to the corresponding one of the curved inner contour lines. In this gasket, the pairs of curved outer and inner contour lines may be extended either outward or inward Preferably, the plate-like gasket body has a thin rubber layer coated thereover.

In accordance with another aspect of the present invention, there is provided a gasket for a reed valve comprising a plate-like gasket body having at least one retainer element integrally formed therewith, the retainer element providing a sloped bearing surface for holding the reed valve at a given angle, the retainer element being defined by a pair of geometrically combined contour lines, the sloped bearing surface of the retainer element being extended between the geometrically combined contour lines, and each of the side walls of the retainer element including a first sloped side wall portion and a second sloped side wall portion defined by the corresponding one of the geometrically combined contour lines, an inclination of the second sloped side wall portion being weaker than that of the first side wall portion, so that the first sloped wall portion exhibits a relatively higher resistance against a deformation of the retainer element. In this type of gasket also, preferably the plate-like gasket body has a thin rubber layer coated thereover.

In accordance with yet another aspect of the present invention, there is provided a gasket for a reed valve comprising a plate-like gasket body having at least one retainer element integrally formed therewith, the retainer element providing a sloped bearing surface for holding the reed valve at a given angle, the retainer element being defined by a pair of geometrically combined contour lines, the sloped bearing surface of the retainer element being extended between the geometrically combined contour lines, and each of the side walls of the retainer element including two sloped side wall portions and a central sloped side wall portion disposed therebetween, these side wall portions being defined by the corresponding one of the geometrically combined contour lines, an inclination of the two sloped side wall portion being weaker than that of the central wall portions, so that the central sloped wall portion exhibits a relatively higher resistance against a deformation of the retainer element. Again, preferably the plate-like gasket body has a thin rubber layer coated thereover.

In accordance with yet another aspect of the present invention, there is provided a gasket for a reed valve comprising a plate-like gasket body having at least one retainer element integrally formed therewith, the retainer element providing a sloped bearing surface for holding the reed valve at a given angle, the retainer elements being defined by a pair of curved contour lines, one of the curved contour lines being included in the plane of the gasket body, and the other curved contour line being disposed above the plane of the gasket, the sloped bearing surface of the retainer element being extended from the other curved contour line toward a root of the reed valve, and a side wall of the retainer element being extended between the curved contour lines. In this gasket, the curved contour lines may be extended outward. Also, the plate-like gasket body preferably has a thin rubber layer coated thereover.

BRIEF DESCRIPTION OF THE DRAWINGS

The present invention will be made more apparent from the ensuing description of the embodiment thereof with reference to the accompanying drawings, wherein.

DESCRIPTION OF THE PREFERRED EMBODIMENTS

Figure 1:
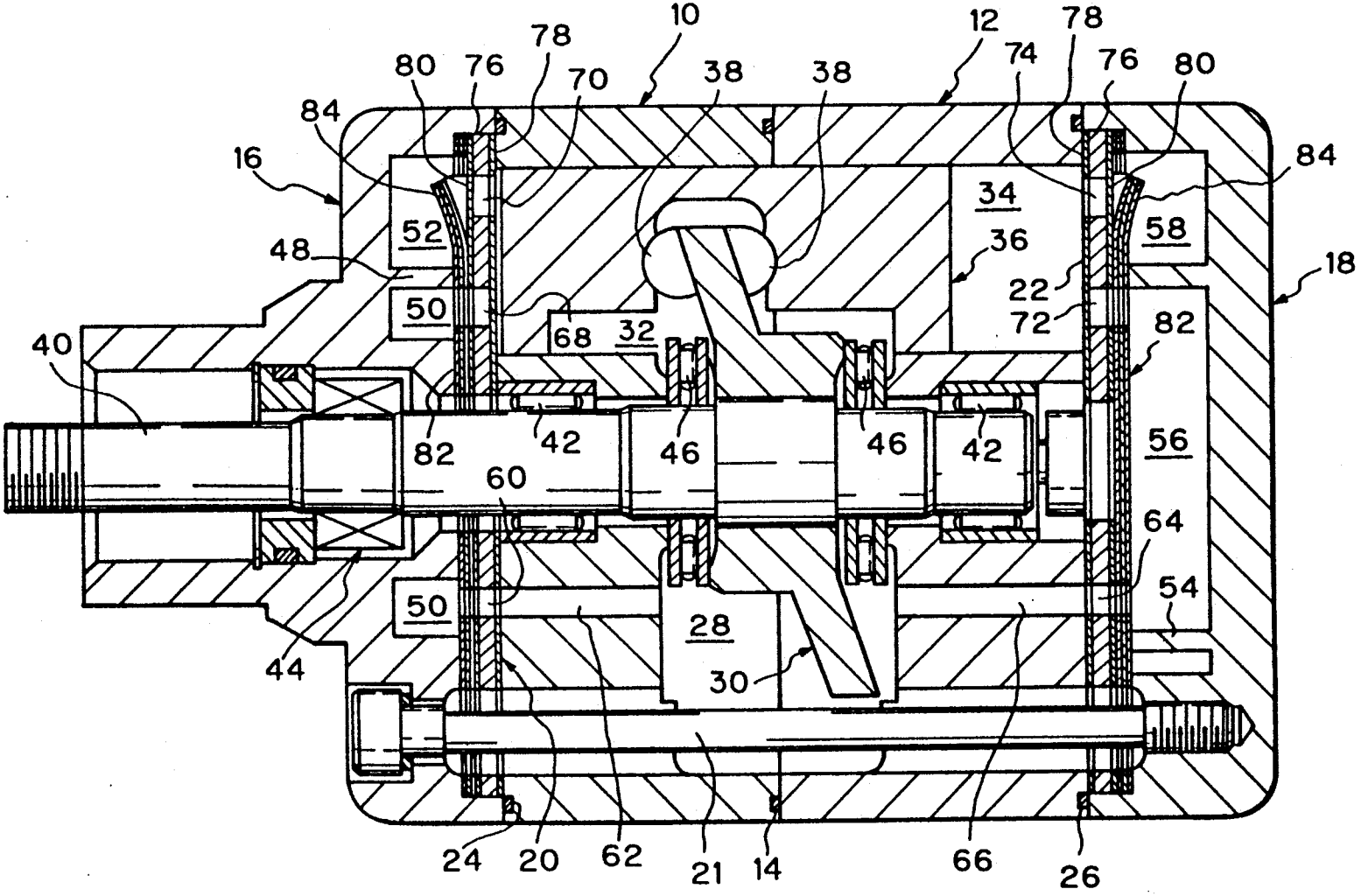
FIG. 1 is a longitudinal cross sectional view of a swash plate type compressor in which a gasket according to the present invention is incorporated.

FIG. 1 shows a swash plate type compressor in which the present invention is embodied, and which is used in an air-conditioning system for a vehicle such as an automobile. The compressor comprises front and rear cylinder blocks 10 and 12 axially aligned and hermetically combined with each other through the intermediary of an 0-ring seal 14, front and rear housings 16 and 18 applied to axial end faces of the combined cylinder blocks 10 and 12, respectively, and front and rear valve plate assemblies 20 and 22 disposed between the front and rear housings 18 and 20 and the axial end faces of the combined cylinder blocks 10 and 12, respectively. All of these parts are assembled as an integrated unit by elongated screws 21 (in FIG. 1, only one is shown) which extend from the front housing 16 into the rear housing 16 through the combined cylinder blocks 10 and 12 and the front and rear valve plate assemblies 20 and 22 therebetween. Note, in FIG. 1, reference numerals 24 and 26 indicate 0-ring seals provided between the front and rear housings 16 and 18 applied to axial end faces of the combined cylinder blocks 10 and 12, respectively.

The combined cylinder blocks 10 and 12 form a swash plate chamber 28 in which a swash plate 30 is disposed, and have cylinder bores 32 and 34 formed radially and circumferentially therein and spaced from each other at regular intervals, respectively. The cylinder bores 32 of the cylinder block 10 are aligned and in register with the cylinder boares 34 of the cylinder block 12, respectively, and each pair of the aligned cylinder bores 32 and 34 of the blocks 14 and 16 slidably receives a double-headed piston 36 operatively engaged with the swash plate 30 through the intermediary of a pair of shoe elements 38 and 38, in such a manner that the piston 36 is reciprocated in the aligned cylinder bores 32 and 34 by a rotational movement of the swash plate 24. The swash plate chamber 28 is in communication with an evaporator of an air-conditioning system (not shown) incorporated in a vehicle such as an automobile, so that the swash plate chamber 28 is fed with a refrigerant including a lubricating oil therefrom.

As shown in FIG. 1, the combined cylinder blocks 10 and 12 are provided with central axial bores, respectively, which receive a drive shaft 40 extending through the swash plate chamber 28. The drive shaft 30 is rotatably supported within the central axial bores of the cylinder blocks 10 and 12 by a pair of radial bearings 42 and 42 provided therein, respectively. One end portion of the drive shaft 40 is extended through the front valve plate assembly 20 and is then protruded behind the outer end face of the front housing 16 so as to be operatively connected to a prime motor of the vehicle for rotation of the drive shaft 40. The protruded end portion of the drive shaft 40 is sealed by a rotary seal unit 44 contained within a central passage of the front housing 16, to prevent the refrigerant from leaking outside of the compressor.

The swash plate 30 is fixedly mounted on the drive shaft 40 within the swash plate chamber 28 so that the swash plate 30 is rotationally driven by the prime motor of the vehicle. Since the swash plate 30 is subjected to a thrust force during an operation of the compressor, a pair of thrust bearings 46 is provided around the drive shaft 40 at the opposite sides of a central portion of the swash plate 30.

The front housing 16 is provided with a partition wall 48 integrally formed therewith and arranged therein to define an inner suction chamber 50 and an outer discharge chamber 52 between the outer surface of the front valve plate assembly 20 and the inner surface of the front housing 16. Similarly, the rear housing 18 is provided with a partition wall 54 integrally formed therewith and arranged therein to define an inner suction chamber 56 and an outer annular discharge chamber 58 between the outer surface of the rear valve plate assembly 22 and the inner surface of the front housing 18. To communicate the swash plate chamber 28 with the suction chamber 50, the front valve plate assembly 20 is provided with inlet openings 60 formed radially and circumferentially therein at regular intervals, and the front cylinder block 10 has passageways 62 extended therethrough and aligned with the inlet openings 60, respectively, whereby the suction chamber 50 is fed with the refrigerant from the swash plate chamber 28 through the passageways 62 and the inlet openings 60. Similarly, to communicate the swash plate chamber 28 with the suction chamber 56, the rear valve plate assembly 22 is provided with inlet openings 64 formed radially and circumferentially therein at regular intervals, and the front cylinder block 12 has passageways 66 extended therethrough and aligned with the inlet openings 64, respectively, whereby the suction chamber 56 is fed with the refrigerant from the swash plate chamber 28 through the passageways 66 and the inlet openings 64.

The front valve plate assembly 16 is provided with sets of a suction port 68 and a discharge port 70 formed radially and circumferentially therein and spaced from each other at regular intervals. Both the suction and discharge ports 68 and 70 in each set, which are radially aligned with each other, are encompassed within an end opening area of the corresponding one of the front cylinder bores 32, as shown in FIG. 1. Similarly, the rear valve plate assembly 18 is provided with sets of a suction port 72 and a discharge port 74 formed radially and circumferentially therein and spaced from each other at regular intervals. Also, both the suction and discharge ports 72 and 74 in each set, which are radially aligned with each other, are encompassed within an end opening area of the corresponding one of the rear cylinder bores 36.

The front valve plate assembly 20 includes a disc-like member 76, an inner reed valve sheet 78 disposed between the end face of the cylinder block 10 and the inner side surface of the disc-like member 76, and an outer reed valve sheet 80 applied to the outer side surface of the disc-like member 76. The disc-like member 76 may be made of a suitable metal material such as steel, and the inner and outer valve sheets 78 and 80 may be made of spring steel, phosphor bronze, or the like. The inner reed valve sheet 78 has suction reed valve elements formed integrally therewith and arranged radially and circumferentially to be in register with the suction ports 68, respectively, whereby each suction reed valve element can be moved so as to open and close the suction port 68, due to a resilient property thereof. The outer reed valve sheet 80 has discharge reed valve elements formed integrally therewith and arranged radially and circumferentially to be in register with the discharge ports 70, respectively, whereby each discharge reed valve element can be moved so as to open and close the discharge port 70, due to a resilient property thereof. The front valve plate assembly 20 also includes a gasket 82 applied to the outer valve sheet 80. The gasket 82 comprises a plate-like gasket body having a very thin rubber layer coated thereover and retainer elements 84 formed integrally therewith. The retainer elements 84 are radially and circumferentially arranged to be opposed to the discharge reed valve elements of the outer valve sheet 80, respectively. Each of the retainer elements 84 provides a sloped bearing surface for the corresponding one of the discharge reed valve elements of the outer valve sheet 80, so that the discharge reed valve element is opened only by a given angle. This also applies to the rear valve plate assembly 22. In FIG. 1, the constructional elements thereof corresponding to those of the front valve plate assembly 20 are indicated by the same reference numerals. Note, the gasket 82 is constructed in accordance with the present invention, as stated in detail hereinafter.

In operation, when each piston 36 is reciprocated in the aligned cylinder bores 32 and 34, a suction stroke is executed in one of the aligned cylinder bores 32 and 34 and a compression stroke is executed in the other cylinder bore. During the suction stroke, the suction reed valve element is opened and the discharge reed valve element is closed, so that the refrigerant is delivered from the suction chamber 50, 56 to the cylinder bore 32, 34 through the suction port 68, 72. During the compression stroke, the suction reed valve element concerned is closed and the discharge reed valve element concerned is opened, so that the delivered refrigerant is compressed and discharged from the cylinder bore 32, 34 into the discharge chamber 52, 58 through the discharge reed valve element.

During the discharge of the refrigerant, the discharge reed valve element is pressed against the sloped bearing surface of the retainer element 84, so that a pressure produced by the discharged refrigerant is directly exerted upon the retainer element 84 as a deformation force thereof. Nevertheless, according to the present invention, the retainer element 84 is able to sufficiently withstand such a deformation force, as discussed in detail hereinafter.

Figure 2:
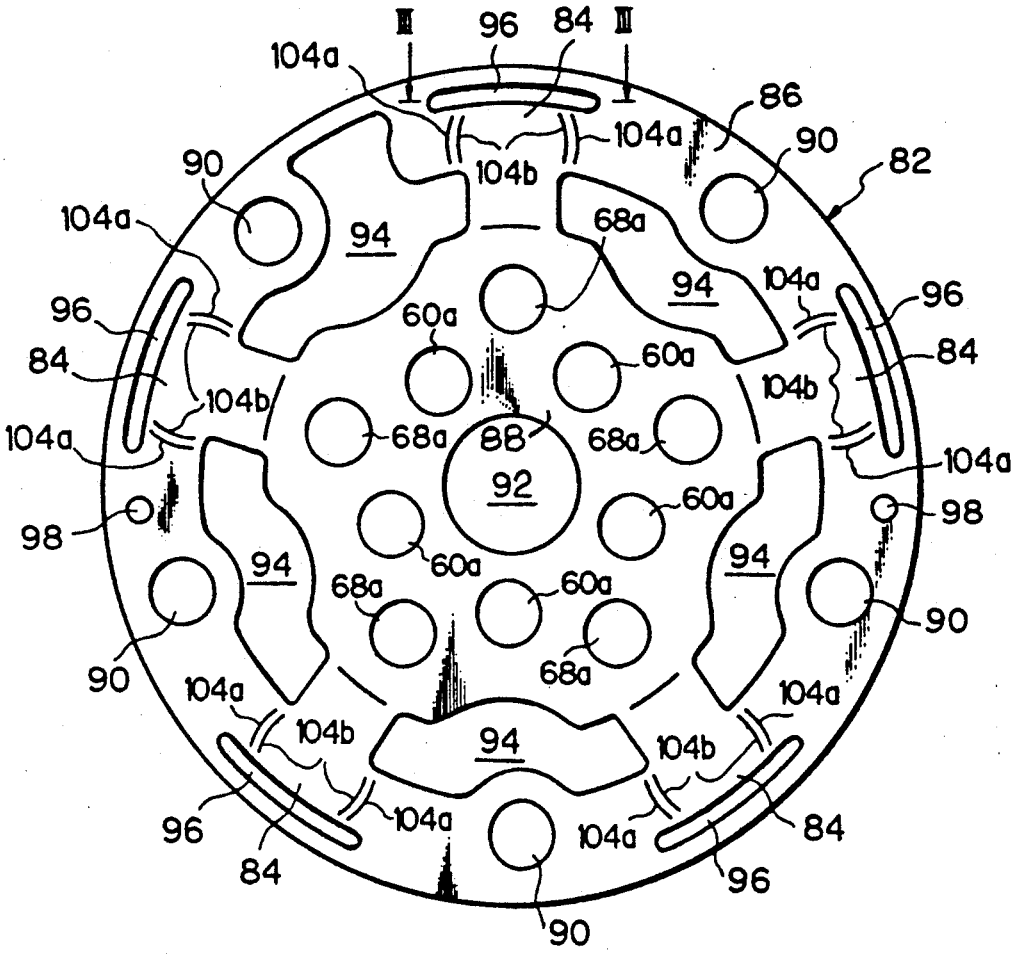
FIG. 2 is a plane view of a gasket according to the present invention.

FIG. 2 is a plane view showing the gasket 82 of the front valve plate assembly 20. The gasket 82 has an outer seal land 86 and an inner seal land 88 formed on an outer surface thereof. When the front valve plate assembly 20 is incorporated in the compressor as a part thereof, as shown in FIG. 1, the outer seal land 86 is hermetically engaged with a peripheral edge of the front housing 16, and the inner seal land 88 is hermetically engaged with the partition wall 48, whereby the suction chamber 50 and the discharge chamber 52 are defined in the front housing 16. In this embodiment, five circular openings 90 for the passage of the elongated screws 21 are formed in the outer seal land 86 and are arranged radially and circumferentially at regular intervals, and a central circular opening 92 for the passage of drive shaft 40 is formed in the inner seal land 88. The inner seal land 88 has two sets of five circular openings 60*a* and 68*a* formed therein, and each set of five circular openings 60*a*, 68*a* is arranged radially and circumferentially at regular intervals. Each of the circular openings 60*a* defines a part of the corresponding inlet opening 60 of the front valve plate assembly 20, and each of the circular openings 68*a* defines a part of the corresponding suction port 68. Each retainer element 84 is disposed between the two adjacent circular openings 90, and a generally sector-shaped opening 94 is extended between two adjacent retainer elements 84. Further, each retainer element 84 is associated with an arcuate opening 96 formed in the outer seal land 86 and extended along an free edge thereof. Also, a pair of positioning holes 98 and 98 are diametrically formed in the outer seal land 86, and a pair of positioning pin elements (not shown) is passed therethrough when the gasket 82 is incorporated in the front valve plate assembly 20 as a part thereof.

Figure 4:
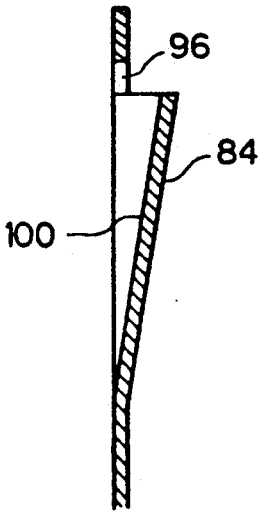
FIG. 4 is a cross sectional view taken along the line IV—IV of FIG. 3.
Figure 3:
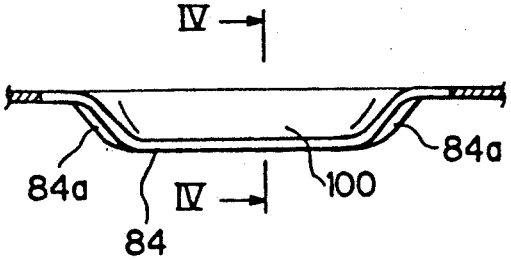
FIG. 3 is a partial cross sectional view taken along the line III—III of FIG. 2.
Figure 5:
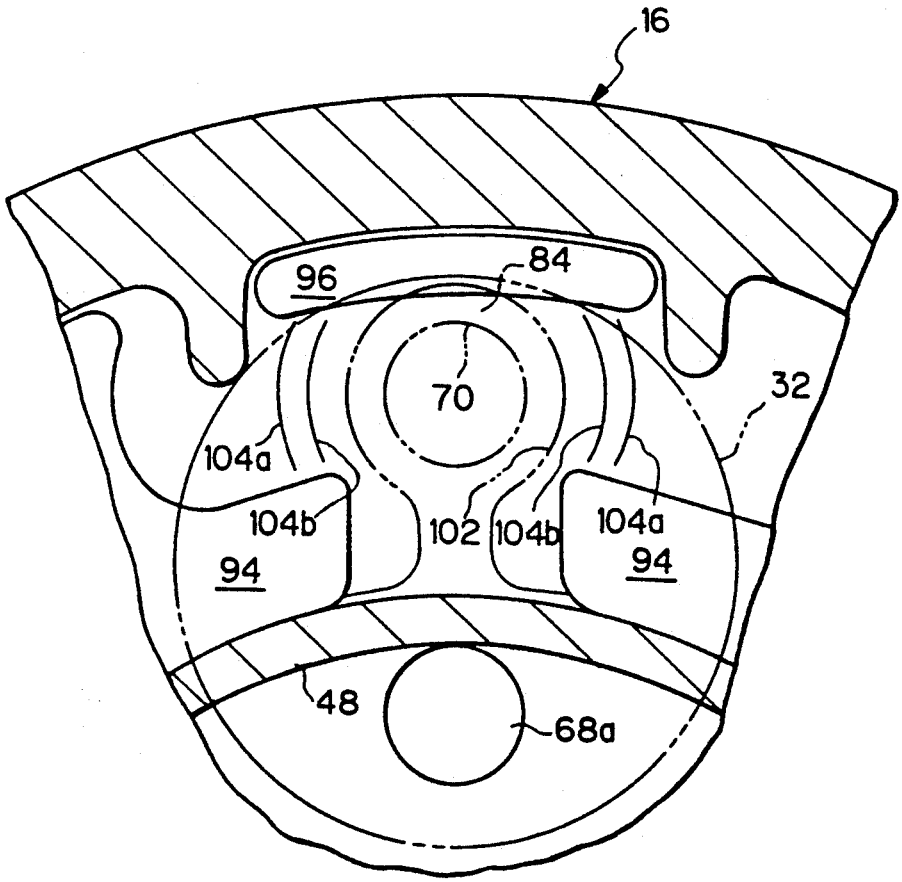
FIG. 5 is an partially enlarged view of FIG. 2, showing a relative positional relationship among a retainer element, a discharge reed valve element, and a cylinder bore, etc.
Figure 6:
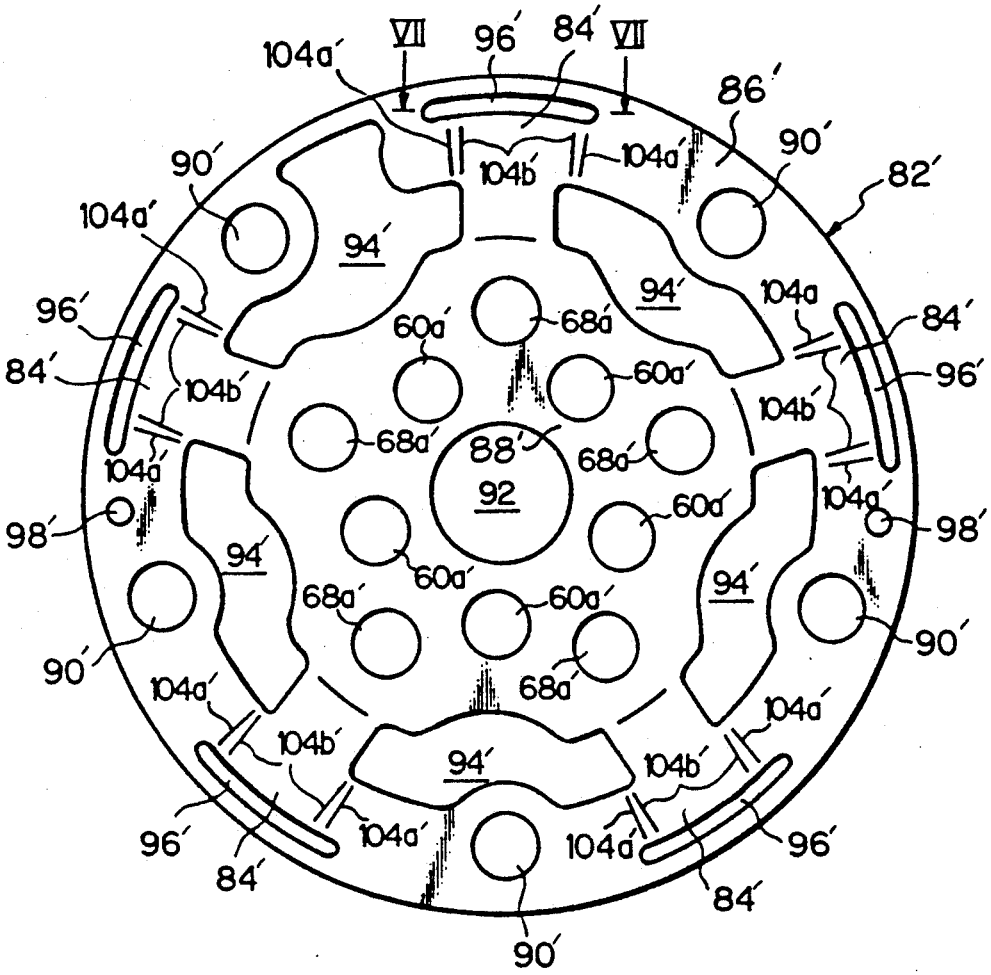
Fig. 6 (PRIOR ART)
FIGS. 6 to 9 are similar to FIGS. 2 to 5, showing a prior art of the present invention.
Figure 8:
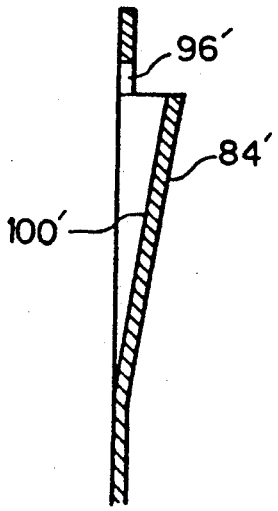
Fig. 8 (PRIOR ART)
Figure 7:
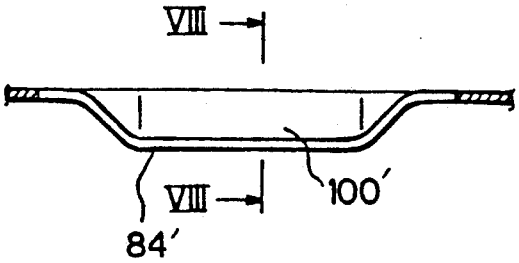
Fig. 7 (PRIOR ART)
Figure 9:
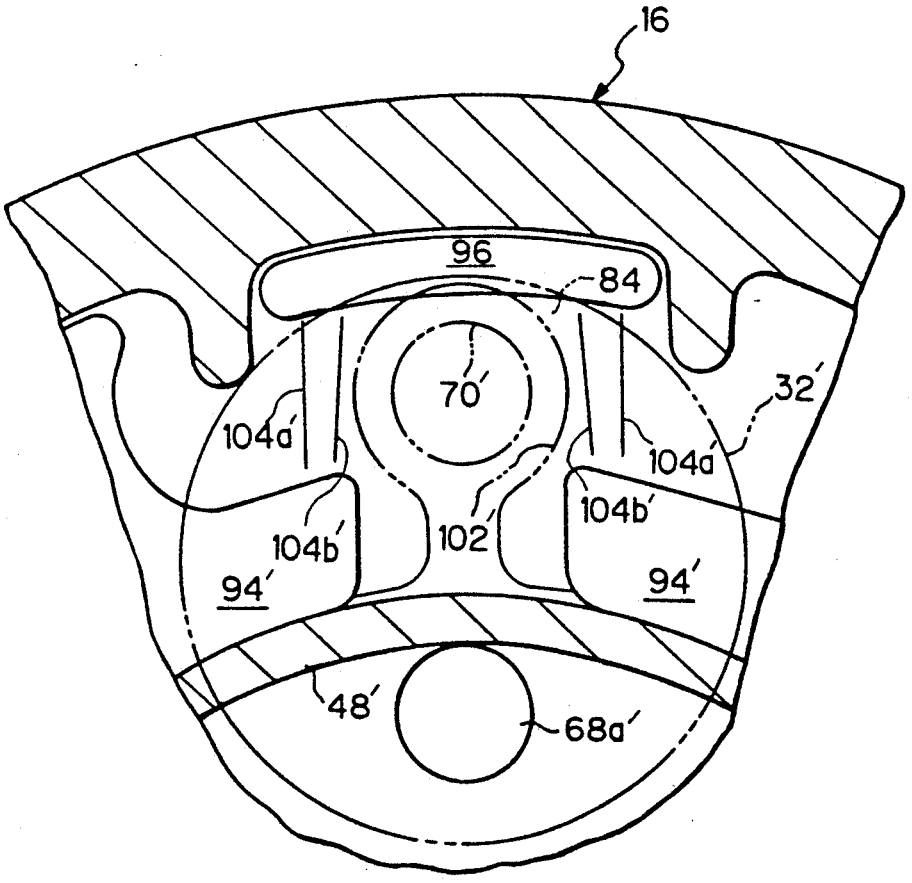
Fig. 9 (PRIOR ART)

According to the present invention, the integral formation of the retainer elements 84 in the gasket 82 is carried out by a press, whereby each retainer element 84 can provide the sloped bearing surface for the corresponding discharge reed valve element. Referring to FIGS. 3 and 4, the sloped bearing surface is indicated by a reference numeral 100, and referring to FIG. 5, the discharge reed valve element is indicated by a reference numeral 102 and is shown by a phantom line. In this embodiment, each retainer element 84 is defined by a pair of outer contour lines 104*a* and 104*a* substantially included in a plane of the gasket 82 and by a pair of inner contour lines 104*b* and 104*b* disposed between the outer contour lines 104*a* and 104*a* and above the plane of the gasket 82. As best shown in FIG. 5, the outer and inner contour lines 104*a*, 104*a*, and 104*b*, 104*b* are curved and extended outward. The sloped bearing surface of the retainer element 84 is extended between the inner contour lines 104*b* and 104*b*, and each of the side walls of the retainer element 84 is extended downward from one of the inner contour lines 104*b* and 104*b* to the corresponding one of the outer contour lines 104*a* and 104*a*. With this arrangement, the retainer element 84 is able to sufficiently withstand the deformation force produced by the discharged refrigerant as mentioned above because, when the retainer element 84 is subjected to the deformation force, none of the curved and outward extended contour lines 104*a*, 104*a*, and 104*b*, 104*b* serves as if it were a hinge.

FIGS. 6 to 9, which are similar to FIGS. 2 to 5, respectively, and in which the features corresponding to those of FIGS. 2 to 5 are indicated by the same references plus a prime, show a conventional type gasket 82' having retainer elements 84' integrally formed therewith, each of which is defined by a pair of outer straight contour lines 104*a'* and 104*a'* substantially included in a plane of the gasket 82' and by a pair of inner straight contour lines 104*b'* and 104*b'* disposed between the outer straight contour lines 104*a'* and 104*a'* and above the plane of the gasket 82. In particular, the sloped bearing surface of the retainer element 84' is extended between the inner straight contour lines 104*b'* and 104*b'*, and each of the side walls of the retainer element 84 is extended downward from one of the inner straight contour lines 104*b'* and 104*b'* to the corresponding one of the outer straight contour lines 104*a'* and 104*a'*. With this arrangement, the retainer element 84' is more sensitive to the deformation force produced by the discharged refrigerant than the retainer element 84 according to the present invention. This is because, when the retainer element 84' is subjected to the deformation force, each straight contour line 104*a'*, 104*a'*, 104*b'*, 104*b'* serves as if it were a hinge.

Figure 10:
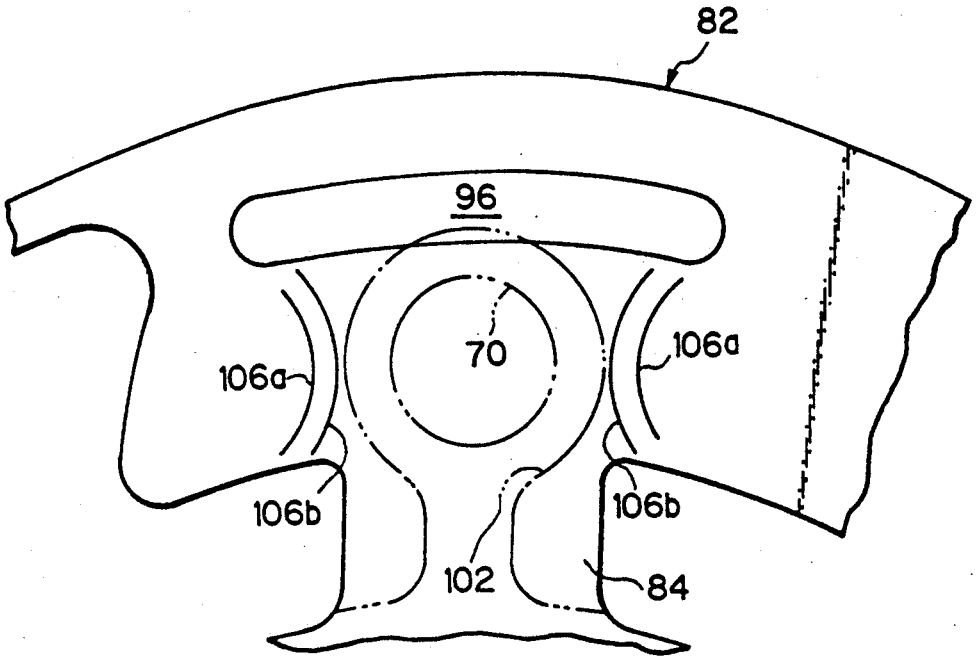
FIG. 10 is similar to FIG. 2, showing a modification of the embodiment shown in FIGS. 2 to 5.

FIG. 10 shows a modification of the embodiment of FIGS. 2 to 5. In this modified embodiment, the retainer element 84 is defined by a pair of outer contour lines 106*a* and 106*a* substantially included in the plane of the gasket 82 and by a pair of inner contour lines 106*b* and 106*b* disposed between the outer gasket 82. As shown in FIG. 10, the outer and inner contour lines 106*a*; 106*a* and 106*b*; 106*b* are curved and depressed inward. The sloped bearing surface of the retainer element 84 is extended between the inner contour lines 106*b* and 1066, and each of the side walls of the retainer element 84 is extended downward from one of the inner contour lines 106*b* and 106*b* to the corresponding one of the outer contour lines 106*a* and 106*a*. With this arrangement, the curved and inward-depressed contour line 106*a*, 106*b*, 106*b* also cannot serve as a hinge, and thus the retainer element is able to sufficiently withstand the deformation force produced by the discharged refrigerant.

Figure 11:
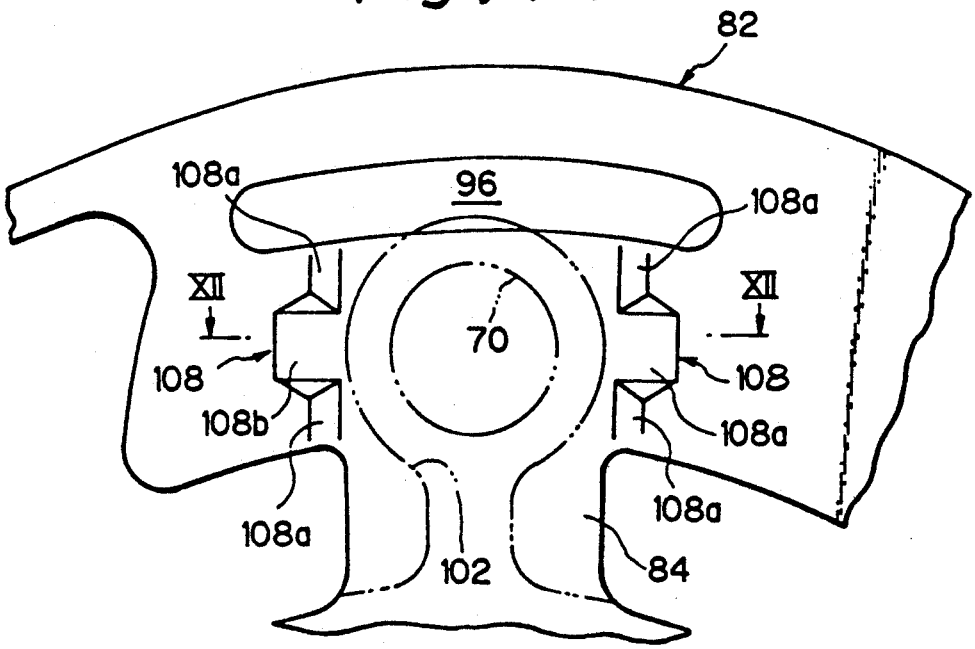
FIG. 11 is similar to FIG. 2, showing another modification of the embodiment shown in FIGS. 2 to 5.
Figure 12:
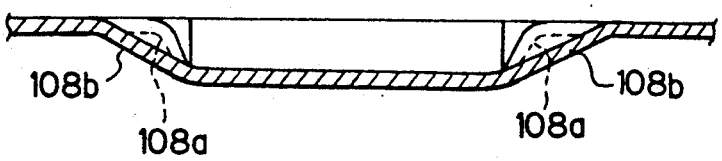
FIG. 12 is a cross sectional view taken along the line XII—XII of FIG. 11.

FIGS. 11 and 12 show another modification of the embodiment of FIGS. 2 to 5. In this modified embodiment, the retainer element 84 is defined by a pair of geometrically combined contour lines 108 and 108. The sloped bearing surface of the retainer element 84 is extended between the geometrically combined contour lines 108 and 108. Each of side walls of the retainer element 84 includes two sloped side wall portions 108*a* and 108*a* and a central sloped side wall portion 108*b* disposed therebetween, and these side wall portions are defined by the corresponding one of the geometrically combined contour lines 108 and 108. As best shown in FIG. 12, an inclination of the central sloped side wall portion 108*b* is weaker than that of the sloped side wall portions 108*a* and 108*a*, so that the central sloped wall portion 108 exhibits a relatively higher resistance against a deformation of the retainer element 84. Thus, in this modified embodiment, the retainer element also can withstand the deformation force produced by the discharged refrigerant.

Figure 13:
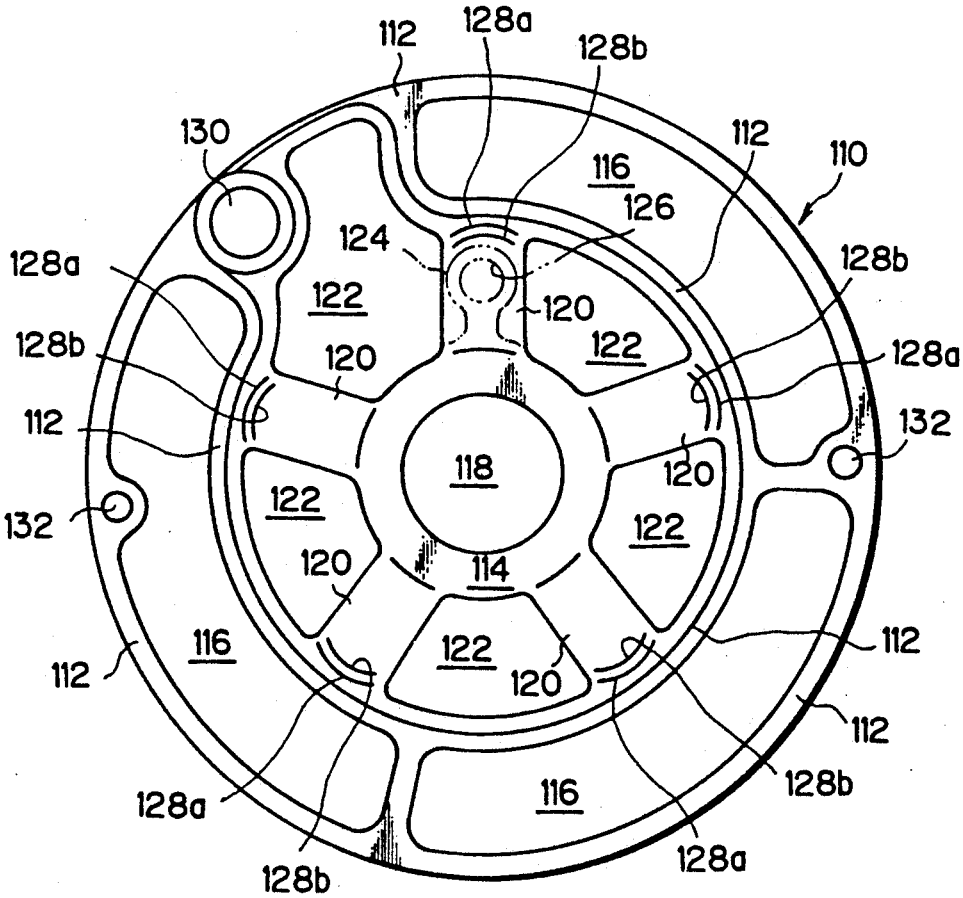
FIG. 13 is a plane view of another type gasket according to the present invention.

FIG. 13 shows another type gasket 110 used in a compressor including a front housing in which a discharge chamber is formed inward and three suction chambers are formed outward along a periphery of the discharge chamber. The gasket 110 has an outer seal land 112 and an inner seal land 114 formed on an outer surface thereof. The outer seal land 112 extends to surround three peripheral sector openings 116, each of which forms a part of a corresponding one of the three suction chambers. The inner seal land surrounds a central opening 118 for a passage of a drive shaft having a swash plate mounted thereon. When the gasket 110 is incorporated in the compressor, the outer and inner seals 112 and 114 are hermetically engaged with a peripheral edge and partition walls of the front housing, so that the three outer suction chambers and the discharge chamber are defined in the front housing. The gasket 110 is provided with five retainer elements 120 formed integrally therewith and arranged radially and circumferentially at regular intervals. A discharge opening 122 is provided between the two adjacent retainer elements 120 and forms a part of the inner discharge chamber. Each of the retainer elements 120 provides a sloped bearing surface for a discharge reed valve 124 that can be moved to open and close a discharge port 126. During a compression stroke, a refrigerant is discharged from the discharge port 124, and is then introduced into the discharge chamber through the discharge openings 122. As shown in FIG. 13, each of the retainer elements 120 is defined by a pair of contour lines 128*a* and 128*b* which are curved and extended outward. The contour line 128*a* is included in the plane of the gasket 110, and the contour line 128*b* is disposed above the plane of the gasket 110. The sloped bearing surface is extended from the contour line 128*b* toward a root of the discharge reed valve 124, and a side wall of the retainer element 120 is extended between the contour lines 128*a* and 128*b*. Similar to the embodiment of FIGS. 2 to 5, the retainer element 120 is able to sufficiently withstand a deformation force produced by the discharged refrigerant, due to the curved and outward-extended contour lines 128*a* and 128*b*.

In this embodiment, the contour lines may be curved and depressed inward. Note, in FIG. 13, reference numeral 130 indicates a hole for a passage of an elongated screw for securely assembling the compressor as an integrated unit, and reference numeral 132 indicates a pair of positioning holes 132 similar to the pair of positioning holes 98 of the first-mentioned embodiment.

Finally, it will be understood by those skilled in the art that foregoing description is of preferred embodiments of the disclosed device, and that various changes and modifications may be made to the present invention without departing from the spirit and scope thereof.

We claim:

1. A gasket for a reed valve comprising a plate-like gasket body having at least one retainer element integrally formed therewith, said retainer element providing a sloped bearing surface for holding the reed valve at a given angle, said retainer element being defined by a pair of curved outer contour lines substantially included in a plane of said gasket body and by a pair of curved inner contour lines disposed between said curved outer contour lines and above the plane of said gasket body, the sloped bearing surface of said retainer element being extended between said curved outer contour lines, and each of side walls of said retainer element being extended from one of said curved outer contour lines to a corresponding one of said curved inner contour lines.

2. A gasket as set forth in claim 1, wherein said pairs of curved outer and inner contour lines are extended outward.

3. A gasket as set forth in claim 1, wherein said pairs of curved outer and inner contour lines are depressed inward.

4. A gasket as set forth in claim 1, wherein said plate-like gasket body has a thin rubber layer coated thereover.

5. A gasket for a reed valve comprising a plate-like gasket body having at least one retainer element integrally formed therewith, said retainer element providing a sloped bearing surface for holding the reed valve at a given angle, said retainer element being defined by a pair of geometrically combined contour lines, the sloped bearing surface of the geometrically combined contour lines, said geometrically combined contour lines forming two sidewalls of said retainer, each of said side walls of said retainer element including a first sloped side wall portion and a second sloped side wall portion which are defined by the corresponding one of said geometrically combined contour lines, an inclination of said second sloped side wall portion being less than that of said first sloped side wall portion, so that said first sloped wall portion exhibits a relatively higher resistance against a deformation of said retainer element.

6. A gasket as set forth in claim 5, wherein said plate-like gasket body has a thin rubber layer coated thereover.

7. A gasket for a reed valve comprising a plate-like gasket body having at least one retainer element integrally formed therewith, said retainer element providing a sloped bearing surface for holding the reed valve at a given angle, said retainer element being defined by a pair of geometrically combined contour lines, the sloped bearing surface of the retainer element being extended between said geometrically combined contour lines, said geometrically combined contour lines forming two sidewalls of said retainer, each of side walls of said retainer element including two sloped side wall portion and a central sloped side wall portions disposed therebetween, these side wall portions being defined by the corresponding one of said geometrically combined contour lines, an inclination of said two sloped side wall portions being less than that of said central wall portion, so that said central sloped wall portion exhibits a relatively higher resistance against a deformation of said retainer element.

8. A gasket as set forth in claim 7, wherein said plate-like gasket body has a thin rubber layer coated thereover.

9. A gasket for a reed valve comprising a plate-like gasket body having at least one retainer element integrally formed therewith, said retainer element providing a sloped bearing surface for holding the reed valve at a given angle, said retainer elements being defined by a pair of curved contour lines, one of said curved contour lines being included in the plane of the gasket body, and the other curved contour line being disposed above the plane of said gasket, the sloped bearing surface of said retainer element being extended from the other curved contour line toward a root of the reed valve, and a side wall of said retainer element being extended between said curved contour lines.

10. A gasket as set forth in claim 9, wherein said curved contour lines are extended outward.

11. A gasket as set forth in claim 9, wherein said plate-like gasket body has a thin rubber layer coated thereover.

* * * * *

UNITED STATES PATENT AND TRADEMARK OFFICE

CERTIFICATE OF CORRECTION

PATENT NO. : 5,186,475

DATED : February 16, 1993

INVENTOR(S) : K. Kawai et al

It is certified that error appears in the above-identified patent and that said Letters Patent is hereby corrected as shown below:

Column 3, line 13, after "inward" insert period --.--.

Column 7, line 67, between "outward extended" insert hyphen -- - --.

Column 8, line 30, after "outer" insert --contour lines 106a and 106a and above the plane of the--; line 35, "1066" should read --106b--; line 40, after "106a," insert --106a,--.

Column 10, line 13, after "the" insert --retainer element being extended between said--; line 37, before "side" insert --said--; line 39, change "portion" to --portions--.

Signed and Sealed this

Fifteenth Day of February, 1994

Bruce Lehman

*Attest:*

BRUCE LEHMAN

*Attesting Officer*

*Commissioner of Patents and Trademarks*